US011027306B2

(12) United States Patent
Vijay et al.

(10) Patent No.: US 11,027,306 B2
(45) Date of Patent: Jun. 8, 2021

(54) COMPACT ULTRASONICALLY PULSED WATERJET NOZZLE

(71) Applicant: VLN ADVANCED TECHNOLOGIES INC., Ottawa (CA)

(72) Inventors: Mohan M. Vijay, Ottawa (CA); Andrew H. Tieu, Ottawa (CA); Wenzhuo Yan, Ottawa (CA); Bruce R. Daniels, Ottawa (CA); Meishing M. Xu, Ottawa (CA)

(73) Assignee: VLN ADVANCED TECHNOLOGIES INC., Ottawa (CA)

( * ) Notice: Subject to any disclaimer, the term of this patent is extended or adjusted under 35 U.S.C. 154(b) by 35 days.

(21) Appl. No.: 15/935,073

(22) Filed: Mar. 26, 2018

(65) Prior Publication Data

US 2018/0272370 A1 Sep. 27, 2018

Related U.S. Application Data

(60) Provisional application No. 62/476,149, filed on Mar. 24, 2017.

(51) Int. Cl.

| | |
|---|---|
| ***B05B 17/00*** | (2006.01) |
| ***B05B 17/06*** | (2006.01) |
| ***B05B 11/00*** | (2006.01) |
| ***B05B 3/02*** | (2006.01) |
| ***B05B 1/30*** | (2006.01) |
| ***B05B 1/24*** | (2006.01) |
| ***B05B 1/08*** | (2006.01) |
| *B05B 3/06* | (2006.01) |

(52) U.S. Cl.

CPC ..... *B05B 17/0653* (2013.01); *B05B 1/083* (2013.01); *B05B 1/24* (2013.01); *B05B 1/30* (2013.01); *B05B 3/02* (2013.01); *B05B 11/0002* (2013.01); *B05B 3/06* (2013.01)

(58) Field of Classification Search

CPC ..... B05B 17/0653; B05B 1/30; B05B 3/02; B05B 11/0002; B05B 1/24; B05B 1/083; B05B 3/06

See application file for complete search history.

(56) References Cited

U.S. PATENT DOCUMENTS

| | | | | |
|---|---|---|---|---|
| 2,949,900 A * | 8/1960 | Bodine | ..... | F02M 27/08 123/472 |
| 3,398,758 A | 8/1968 | Unfried | | |
| 3,729,871 A | 5/1973 | Taylor | | |
| 4,067,150 A | 1/1978 | Merrigan | | |
| 4,463,904 A | 8/1984 | Bray, Jr. | | |

(Continued)

FOREIGN PATENT DOCUMENTS

| | | |
|---|---|---|
| DE | 10158622 A1 | 6/2003 |
| DE | 102005061401 A1 | 6/2007 |

(Continued)

*Primary Examiner* — Qingzhang Zhou
(74) *Attorney, Agent, or Firm* — Honigman LLP

(57) ABSTRACT

A pulsed waterjet apparatus comprising a water pump for generating a pressurized waterjet, an ultrasonic signal generator for generating an ultrasonic signal and an ultrasonic nozzle comprising an ultrasonic transducer for converting the ultrasonic signal into vibrations that pulse the pressurized waterjet to generate a pulsed waterjet, an exit orifice through which the pulsed waterjet exits and an inflow inlet axially aligned with the exit orifice.

5 Claims, 12 Drawing Sheets

(56) References Cited

U.S. PATENT DOCUMENTS

| | | | | |
|---|---|---|---|---|
| 4,478,368 | A | 10/1984 | Yie | |
| 4,555,872 | A | 12/1985 | Yie | |
| 4,569,161 | A | 2/1986 | Shipman | |
| 4,666,083 | A | 5/1987 | Yie | |
| 4,681,264 | A | 7/1987 | Johnson, Jr. | |
| 4,765,540 | A | 8/1988 | Yie | |
| 5,018,317 | A | 5/1991 | Kiyoshige et al. | |
| 5,125,582 | A | 6/1992 | Surjaatmadja et al. | |
| 5,155,946 | A | 10/1992 | Domann | |
| 5,217,163 | A | 6/1993 | Henshaw | |
| 5,291,957 | A | 3/1994 | Curlett | |
| 5,421,516 | A | 6/1995 | Saitou et al. | |
| 5,538,191 | A | 7/1996 | Holl | |
| 5,547,376 | A | 8/1996 | Harrel | |
| 5,643,058 | A | 7/1997 | Erichsen et al. | |
| 5,752,829 | A | 5/1998 | Goldsmith et al. | |
| 5,849,099 | A | 12/1998 | McGuire | |
| 5,862,871 | A | 1/1999 | Curlett | |
| 5,927,306 | A | 7/1999 | Izumi et al. | |
| 6,000,308 | A | 12/1999 | LaFountain et al. | |
| 6,026,584 | A | 2/2000 | Wegman | |
| 6,036,584 | A | 3/2000 | Swinkels et al. | |
| 6,189,547 | B1 | 2/2001 | Miyamoto et al. | |
| 6,223,996 | B1 | 5/2001 | Yamamoto | |
| 6,240,945 | B1 | 6/2001 | Srinath et al. | |
| 6,244,927 | B1 | 6/2001 | Zeng | |
| 6,305,261 | B1 | 10/2001 | Romanini | |
| 6,444,259 | B1 | 9/2002 | Subramanian et al. | |
| 6,464,567 | B2 | 10/2002 | Hashish et al. | |
| 6,695,686 | B1 | 2/2004 | Frohlich et al. | |
| 6,797,342 | B1 | 9/2004 | Sanchez et al. | |
| 6,935,860 | B2 | 8/2005 | Rasmussen | |
| 6,953,158 | B2 * | 10/2005 | Liskow | F02M 51/0603 239/102.2 |
| 6,976,507 | B1 | 12/2005 | Webb et al. | |
| 7,108,585 | B1 | 9/2006 | Dorfman et al. | |
| 7,549,429 | B2 | 6/2009 | Nunomura et al. | |
| 7,594,614 | B2 | 9/2009 | Vijay et al. | |
| 7,762,869 | B2 | 7/2010 | Yoon | |
| 7,830,070 | B2 | 11/2010 | Babaev | |
| 8,297,540 | B1 | 10/2012 | Vijay | |
| 8,691,014 | B2 | 4/2014 | Vijay | |
| 9,757,756 | B2 | 9/2017 | Vijay et al. | |
| 2002/0066770 | A1 | 6/2002 | James et al. | |
| 2002/0098776 | A1 | 7/2002 | Dopper | |
| 2004/0097171 | A1 | 5/2004 | Liwszyc et al. | |
| 2006/0113400 | A1 | 6/2006 | Dodson | |
| 2007/0063066 | A1 | 3/2007 | Vijay et al. | |
| 2007/0098912 | A1 | 5/2007 | Raybould et al. | |
| 2008/0160332 | A1 | 7/2008 | Dighe et al. | |
| 2008/0201973 | A1 | 8/2008 | Chabot et al. | |
| 2009/0200390 | A1 | 8/2009 | Babaev | |
| 2009/0224066 | A1 | 9/2009 | Riemer | |
| 2010/0015892 | A1 * | 1/2010 | Vijay | B05B 17/0607 451/36 |
| 2010/0124872 | A1 | 5/2010 | Hashish et al. | |
| 2011/0011952 | A1 | 1/2011 | Brusa | |
| 2011/0247554 | A1 | 10/2011 | Vijay | |
| 2011/0250361 | A1 | 10/2011 | Vijay | |
| 2015/0165465 | A1 * | 6/2015 | Hammer | B05B 17/0615 239/102.2 |

FOREIGN PATENT DOCUMENTS

| | | | |
|---|---|---|---|
| EP | 0647505 | A1 | 4/1995 |
| EP | 0703040 | A1 | 3/1996 |
| EP | 1016735 | A1 | 7/2000 |
| EP | 1160339 | A2 | 12/2001 |
| EP | 2145689 | A1 | 1/2010 |
| GB | 2335202 | A | 9/1999 |
| JP | 58052467 | | 3/1983 |
| JP | 59070757 | | 4/1984 |
| JP | 61037955 | | 2/1986 |
| WO | 9213679 | A1 | 8/1992 |
| WO | 9814638 | A1 | 4/1998 |
| WO | 2005042177 | A1 | 5/2005 |

* cited by examiner

COMPACT ULTRASONICALLY PULSED WATERJET NOZZLE

CROSS REFERENCE TO RELATED APPLICATION

The present application claims the filing benefits of U.S. provisional application Ser. No. 62/476,149, filed Mar. 24, 2017, which is hereby incorporated herein by reference in its entirety.

FIELD OF THE INVENTION

The present invention relates generally to forced pulsed waterjets and, in particular, to ultrasonically modulated forced pulsed waterjets.

BACKGROUND OF THE INVENTION

A forced pulsed waterjet is an interrupted, non-continuous jet of pressurized water defined by discrete slugs or pulses of water. An ultrasonically pulsed waterjet uses an ultrasonic transducer to modulate the waterjet at ultrasonic frequencies, for example 20 kHz. U.S. Pat. No. 7,594,614 (Vijay et al.), which is hereby incorporated by reference, discloses an ultrasonic waterjet apparatus. U.S. Pat. No. 9,757,756 (Vijay et al.), which is hereby incorporated by reference, discloses a method and apparatus for prepping bores and curved inner surfaces with a rotating high-frequency forced pulsed waterjet.

A more compact nozzle would be highly desirable in order to prep bores of small diameter.

SUMMARY OF THE INVENTION

Disclosed in this specification and the drawings is a novel pulsed waterjet apparatus. The nozzle is compact and thus is particularly useful for prepping surfaces in applications where spaced is limited, such as inside bores. The invention has various embodiments which will be described below in greater detail.

One inventive aspect of the present disclosure is a pulsed waterjet apparatus comprising a water pump for generating a pressurized waterjet, an ultrasonic signal generator for generating an ultrasonic signal and an ultrasonic nozzle comprising an ultrasonic transducer for converting the ultrasonic signal into vibrations that pulse the pressurized waterjet to generate a pulsed waterjet, an exit orifice through which the pulsed waterjet exits from the nozzle and a water inflow inlet axially aligned with the exit orifice.

Another inventive aspect of the present disclosure is a pulsed waterjet apparatus comprising a water pump for generating a pressurized waterjet, an ultrasonic signal generator for generating an ultrasonic signal and a ultrasonic nozzle comprising an ultrasonic transducer for converting the ultrasonic signal into vibrations that pulse the pressurized waterjet to generate a pulsed waterjet, an exit orifice through which the pulsed waterjet exits from the nozzle and an air inlet axially aligned with the exit orifice.

Yet another aspect of the present disclosure is a method of prepping a surface using an ultrasonically pulsed waterjet. The method entails a pulsed waterjet apparatus comprising a water pump for generating a pressurized waterjet, an ultrasonic signal generator for generating an ultrasonic signal and a rotatable ultrasonic nozzle comprising an ultrasonic transducer for converting the ultrasonic signal into vibrations that pulse the pressurized waterjet to generate a pulsed waterjet, two exit orifices through which the pulsed waterjet exits from the nozzle and a water inflow inlet axially aligned with an axis of rotation of the nozzle.

The above is a summary of some main aspects or embodiments of the invention. The summary is presented solely to provide a basic overview of the invention. The summary is not an exhaustive description of the invention. It is not intended to identify key, essential or critical elements of the invention or to delineate the scope of the invention. Its sole purpose is to present some aspects or embodiments of the invention in a simplified form as a prelude to the more detailed description that is presented later.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION OF EMBODIMENTS

In general, the present invention is an ultrasonically pulsed waterjet nozzle. The term "waterjet" for the purposes of this specification shall be construed as including any other liquidjet. To clarify the nomenclature for this specification, the pulsed waterjet apparatus is meant to include the ultrasonically pulsed waterjet nozzle as well as water pump and the ultrasonic generator. The apparatus may include additional components as will be described below.

Figure 1:
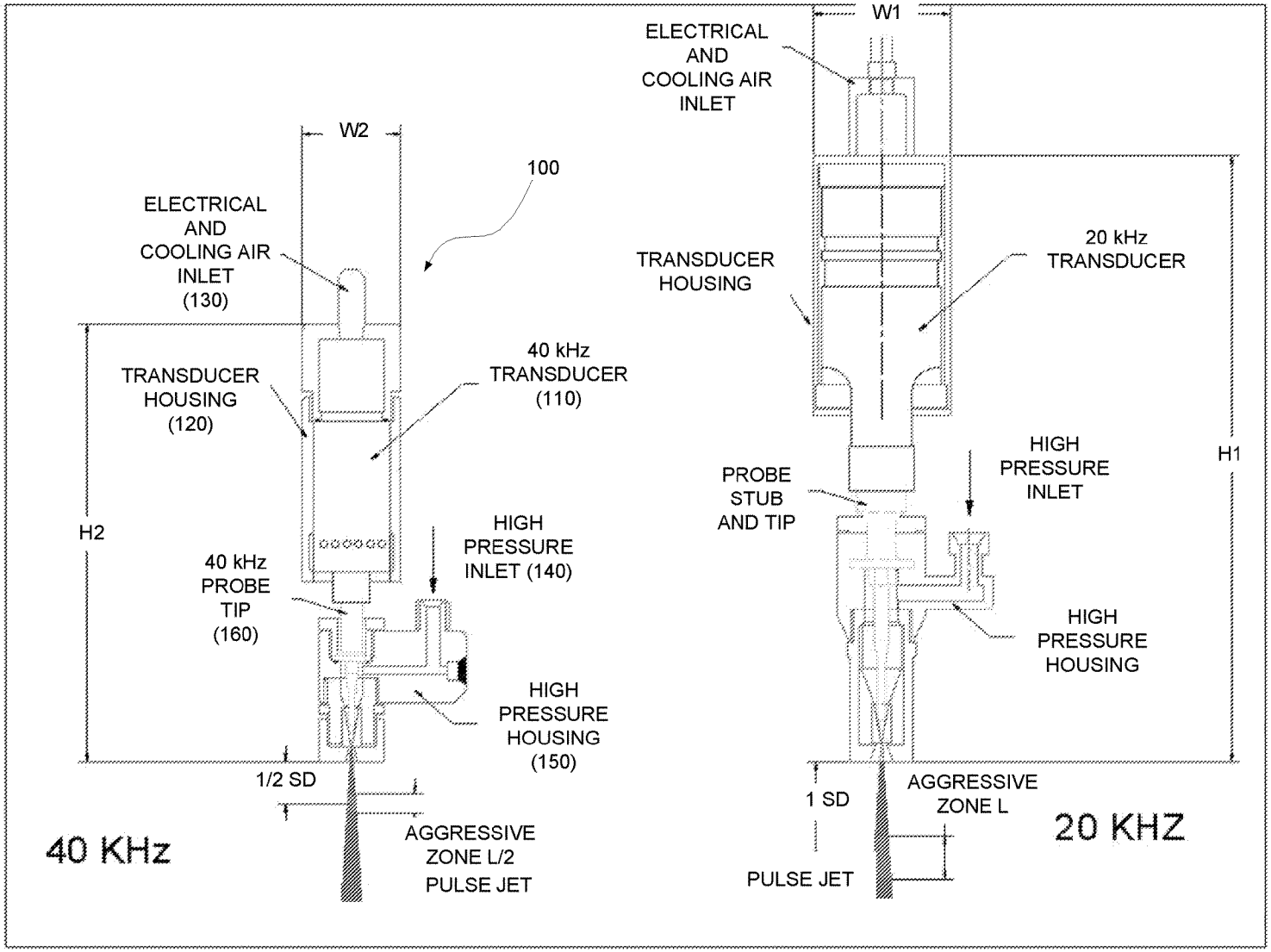
FIG. 1 is a side view of a compact ultrasonically pulsed waterjet nozzle compared to a prior-art nozzle.
Figure 1A:
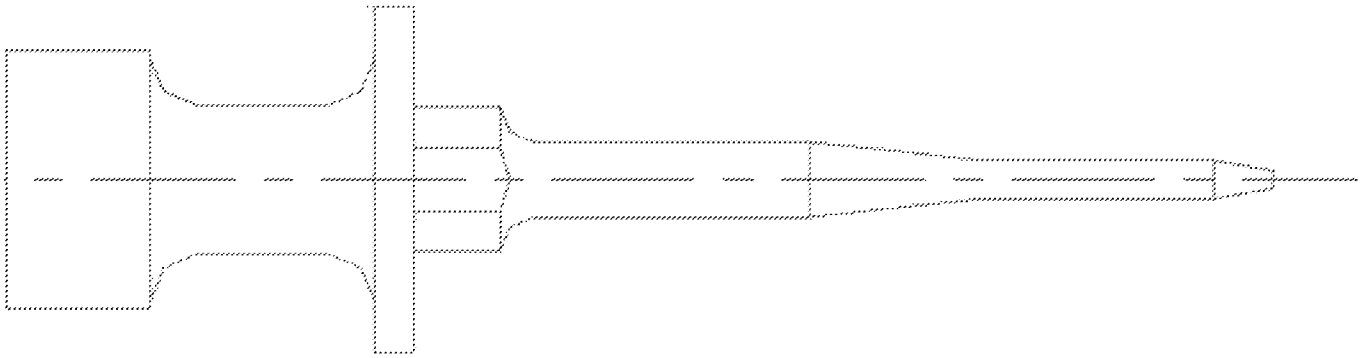
FIG. 1A is a side view of a prior-art 20 kHz probe (microtip).
Figure 1B:
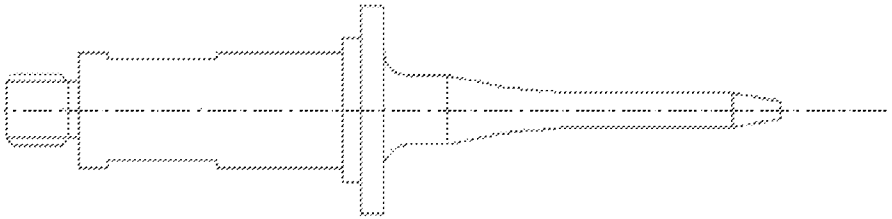
FIG. 1B is a side view of a compact 40-kHz probe (microtip).

A compact ultrasonic nozzle generally denoted by reference numeral 100, e.g. a 40-kHz ultrasonic nozzle, is depicted by way of example in FIG. 1. In the embodiment shown by way of example in FIG. 1, the compact ultrasonic nozzle 100 has an ultrasonic transducer 110, e.g. a 40-kHz transducer, which may be, for example, a piezoelectric transducer held or contained within a transducer housing 120. The nozzle 100 includes an electrical wire and cooling air inlet 130, a high-pressure water inlet 140 and a high-pressure housing 150. In comparison with a 20-kHz nozzle, as shown in FIG. 1, the 40-kHz nozzle is far more compact. The compact 40-kHz nozzle also has a probe tip 160. The relative sizes of the prior-art 20-kHz probe (microtip) and the compact 40-kHz probe (microtip) are shown in FIG. 1A and FIG. 1B.

In some applications, the 40-kHz nozzle outperforms the 20-kHz nozzle in terms of mass loss, surface prepping ability, and coating removal in fast rotational applications and also in other fast-moving applications (i.e. applications where the nozzle has a high traverse velocity, Vtr).

The 40-kHz nozzle includes a 40-kHz transducer that is smaller in diameter than the 20-kHz transducer. In one example implementation, which is not meant to be limiting, the 40-kHz transducer is 1.65" in diameter as compared to 2.75" for the 20-kHz transducer. A smaller diameter nozzle is beneficial because it enables insertion into smaller bores. The length-to-diameter ratio of the 40-kHz nozzle is 20:2.25 whereas that of the 20-kHz nozzle is 14:3.125.

The 40-kHz nozzle is also shorter than the 20-kHz nozzle also making it more compact than the 20-kHz nozzle. As such, the 40-kHz nozzle is more manoeuvrable in tight spaces.

The 40-kHz nozzle is not only smaller but also lighter in weight. The 40-kHz nozzle is approximately ⅕ of the weight of the 20-kHz nozzle. This is useful for almost all applications, especially for handheld devices.

Being smaller also minimizes the costs associated with manufacturing the ancillary parts of the nozzle, as the ancillary parts are manufactured from expensive materials like titanium (e.g. probes, housings, etc.) A smaller nozzle body means less material, less weight, and less cost to make. O-rings are also smaller and cheaper.

The 40-kHz nozzle operates at half the standoff distance (SD) compared to the 20-kHz nozzle as shown by way of example in FIG. 1. This can be advantageous or disadvantageous depending on the application. In the case of small bore applications, e.g. bores under 3 inches, this attribute is a benefit.

The 40-kHz nozzle has a narrower aggressive zone meaning it is more sensitive to standoff distance change. At higher pressures and high robot accuracy this shortcoming is not an issue, although for handheld applications it is more desirable to have more tolerance. In the case of concrete demolition it is better to have wider aggressive zone due to the depth of cut.

Tests have shown the 40-kHz nozzle produces more uniform surface finish compared to the 20-kHz nozzle. This attribute is ideal for peening and surface preparation where surface treatment uniformity is critical.

For greater certainty, "surface prepping" means roughening a substrate surface by changing the surface roughness (as measured by Ra or Rz values) from a first roughness to a second (different roughness). The expression "surface prepping" does not include cleaning a surface, which involves removing dirt, dust, grime or other unwanted particles from the surface of the part. The expression "surface prepping" shall also not be confused with coating removal. In refurbishment of an old or used part, a dirty coated part is first cleaned to remove dirt and grime, then it is de-coated to remove the partially worn-off coating and then it is prepped as a prelude to applying a new coating.

Figure 2:
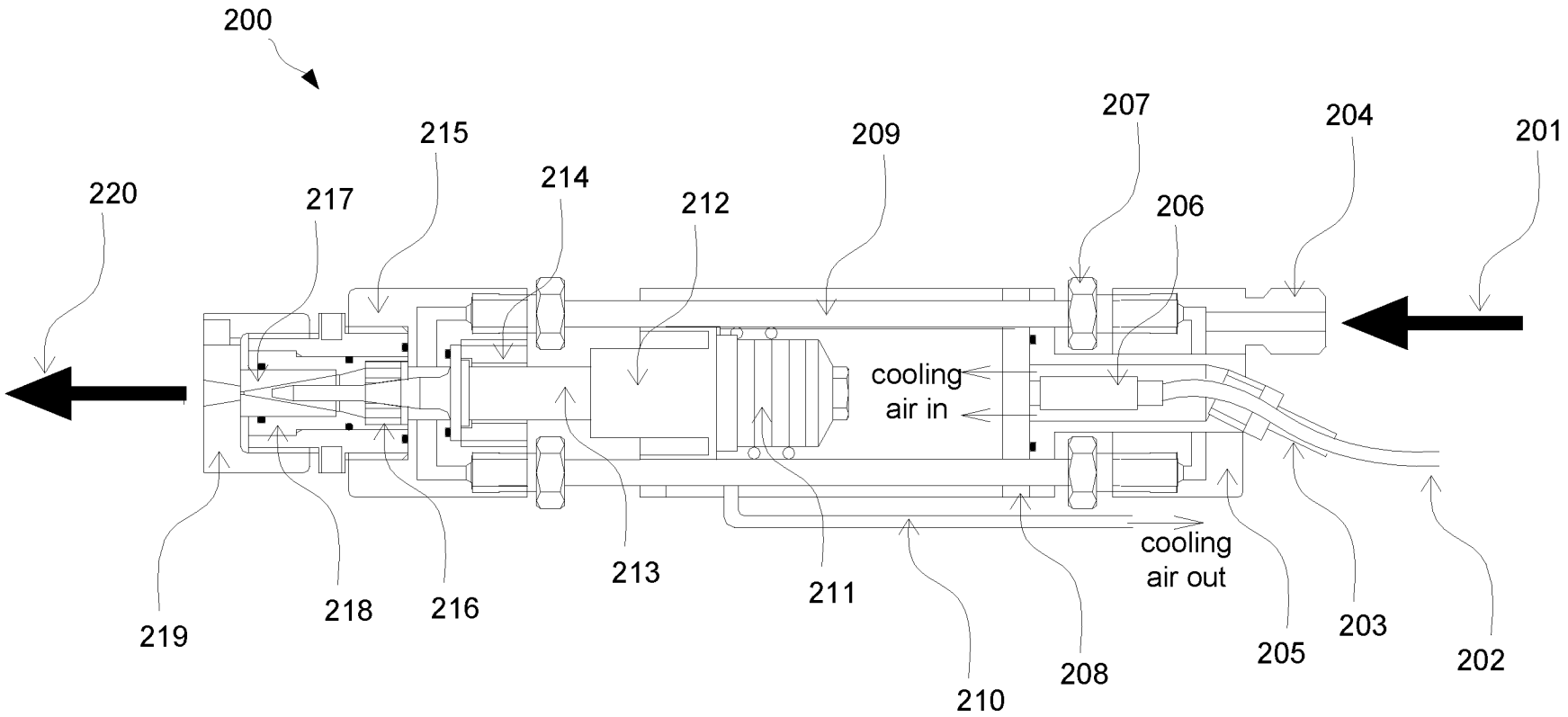
FIG. 2 is a cross-sectional view of a single-jet inflow (axial flow) nozzle in accordance with one embodiment of the present invention.

FIG. 2 is a cross-sectional view of a single-jet inflow (axial flow) nozzle in accordance with one embodiment of the present invention.

In the embodiment depicted in FIG. 2, an inflow (axial flow) nozzle assembly (or simply "nozzle") includes a high-pressure (HP) water flow 201, which enters the nozzle assembly through an adaptor 204. The high-pressure water is channelled through a manifold 205 which is connected by nuts 207 to three high-pressure tubes 209. An ultrasonic coaxial cable delivering cooling air 202 enters the nozzle assembly through a hose barb connector 203 that terminates at the transducer housing 208 via an electrical connector 206.

Cooling air to cool the transducer, which is composed of piezoelectric crystal stacks 211, enters the transducer housing 208 and exits through the air hose 210. An ultrasonic generator (not shown in this figure) supplies ultrasonic (high-frequency) electrical pulses to the transducer 211. The transducer converts the electrical pulses into mechanical vibrations which are transferred to the probe 213 through the acoustical horn 212. The vibration of the tip of the probe in the nozzle 217 is amplified by the reduction in the areas of cross sections of the horn and the probe. The probe is positioned in the high-pressure chamber 215, which is connected to the transducer housing 108 by a nut 214. Water enters the high-pressure chamber through the high-pressure tubes 209, passes through a flow straightener 216, and emerges from the nozzle insert 217 as an ultrasonically pulsed waterjet 220. The nozzle insert is located in a holder 218 and is held in place by a cap 219. The overall dimensions of the assembly are 10.5-in in length and 2-in in diameter. The dimensions provided in this specification are presented solely to illustrate specific examples and are not meant to limiting.

Figure 3:
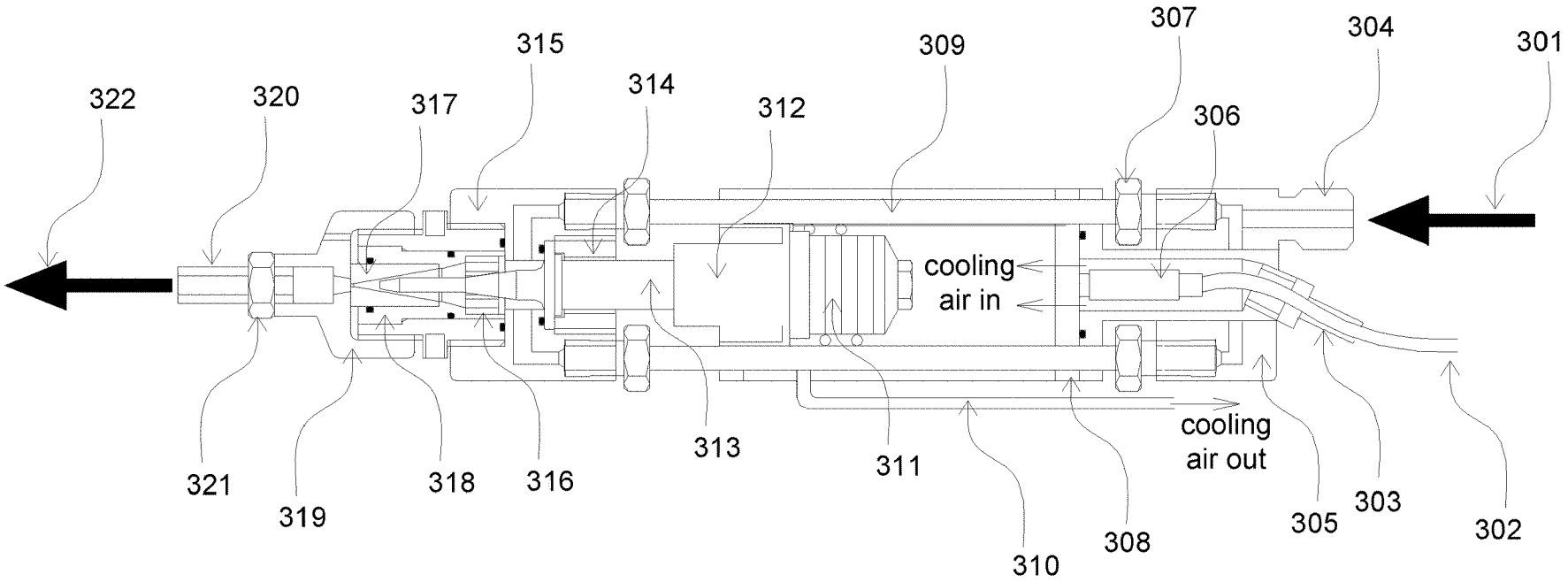
FIG. 3 is a cross-sectional view of the nozzle of FIG. 2 that further has a shroud for operating when submerged.

FIG. 3 is a cross-sectional view of the nozzle of FIG. 2 that further has a shroud for operating when submerged.

In the embodiment depicted in FIG. 3, an inflow (axial flow) nozzle assembly (or simply "nozzle") includes a high-pressure (HP) water flow 301, which enters the nozzle assembly through an adaptor 304. The high-pressure water is channelled through a manifold 305 which is connected by nuts 307 to three high-pressure tubes 309. An ultrasonic coaxial cable delivering cooling air 302 enters the nozzle assembly through a hose barb connector 303 that terminates at the transducer housing 308 via an electrical connector 306.

Cooling air to cool the transducer, which is composed of piezoelectric crystal stacks 311, enters the transducer housing 308 and exits through the air hose 310. An ultrasonic generator (not shown in this figure) supplies ultrasonic (high-frequency) electrical pulses to the transducer 311. The transducer converts the electrical pulses into mechanical vibrations which are transferred to the probe 313 through the acoustical horn 312. The vibration of the tip of the probe in the nozzle 317 is amplified by the reduction in the areas of cross sections of the horn and the probe. The probe is positioned in the high-pressure chamber 315, which is connected to the transducer housing 308 by a nut 314. Water enters the high-pressure chamber through the high-pressure tubes 309, passes through a flow straightener 316, and emerges from the nozzle insert 317 as an ultrasonically pulsed waterjet 322. The nozzle insert is located in a holder 318 and is held in place by a cap 319. The nozzle has an integrated mechanical shroud 320 to protect the pulse jet when operated in a submerged environment, e.g. underwater. The length of the shroud, which is dependent on the required standoff distance, can be adjusted and locked by the threaded and locking nut mechanism of the shroud 321. The pulse jet 322 emerging from the assembly is effective both "in-air" and submerged (underwater) environments. The overall dimensions of the assembly are 11-in in length and 2-in in diameter. Again it bears noting that the dimensions are solely presented as an example and should be construed as limiting the invention.

Figure 4:
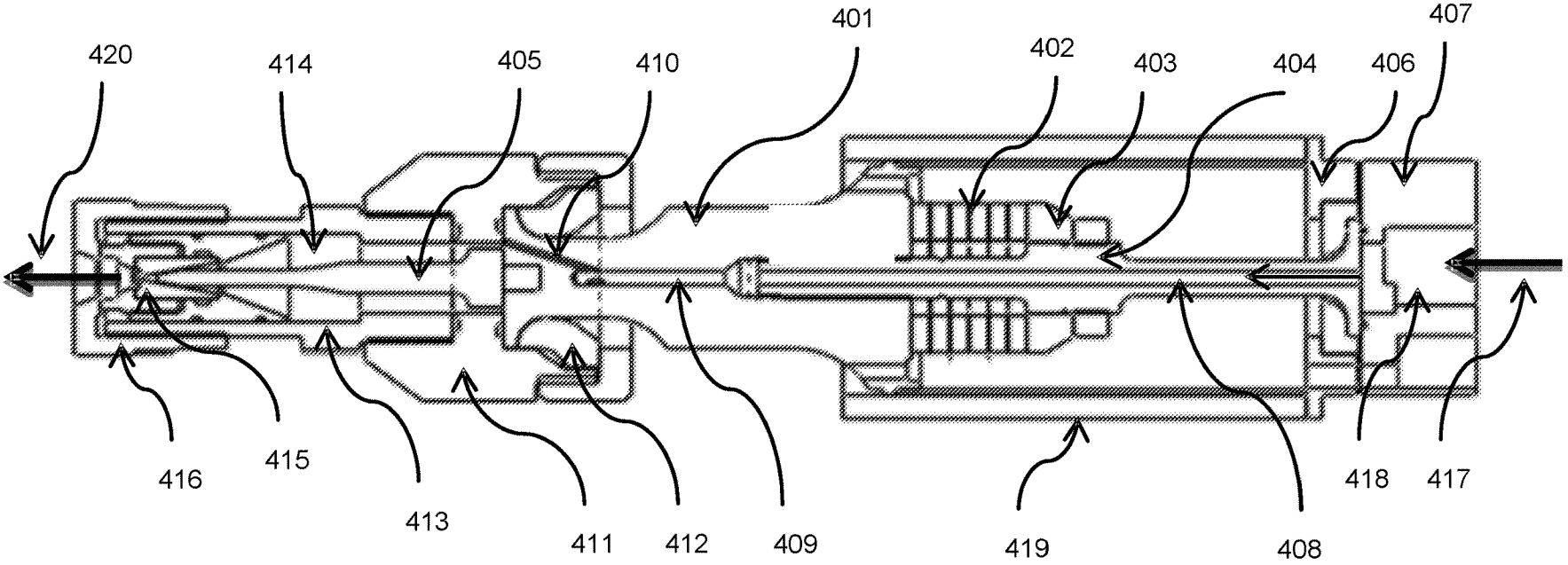
FIG. 4 is a cross-sectional view of a single-orifice inflow nozzle in accordance with another embodiment.

FIG. 4 is a cross-sectional view of a single-orifice inflow nozzle in accordance with another embodiment.

In the embodiment depicted in FIG. 4, the nozzle assembly is constructed with a central axial water passage to enable the high pressure (HP) water to flow axially through the ultrasonic transducer. The nozzle assembly of FIG. 4 is particularly useful for surface processing (e.g. stripping coatings from a substrate material, prepping surfaces by uniformly roughening the surface). The compact nozzle is particularly useful for prepping internal surfaces of bores (ducts, pipes, engine cylinders, etc) having an internal diameter of the order of 3.5-in, although it will be appreciated that the nozzle can be scaled up or down to prep larger or smaller bores. As shown by way of example in FIG. 4, the nozzle assembly includes an ultrasonic transducer main body 401, a piezoelectric disk stack 402, which may be mounted on a threaded shaft 404 and held in place by a nut 403. The nozzle assembly includes a microtip (probe) 405. In this embodiment, the main body 401, the shaft 404, and the microtip 405 are all tuned to half the wavelength of the piezoelectric stack 402.

The nozzle assembly of FIG. 4 includes a high-pressure chamber 411, a tightening nut 412, a nozzle adapter 413, an orifice insert 415, and a threaded holding cap 416. High-pressure water 417 enters the port 418 on the adaptor 407, into the bore 408 on the shaft 404. The water is sealed by the cap 407, the nut 406, which is connected to the ultrasonic protecting case 419, and the flange on the shaft 404. Water flows through the bore in the shaft 404, enters into the hole 409, drilled in the main body 401, enters into the cavity 414, through three bores 410, drilled in the main body 401. The water stream is modulated by the ultrasonic waves generated by the vibrating horn and issues from the orifice insert as an ultrasonic (high-frequency) pulsed waterjet 420. The frequency (f) of the pulses can be in the range of $10<f<100$-kHz. The overall dimensions are 15-in in length and 3.0-in in diameter. As noted above, the dimensions are solely presented as an example and should be construed as limiting the invention.

Figure 5:
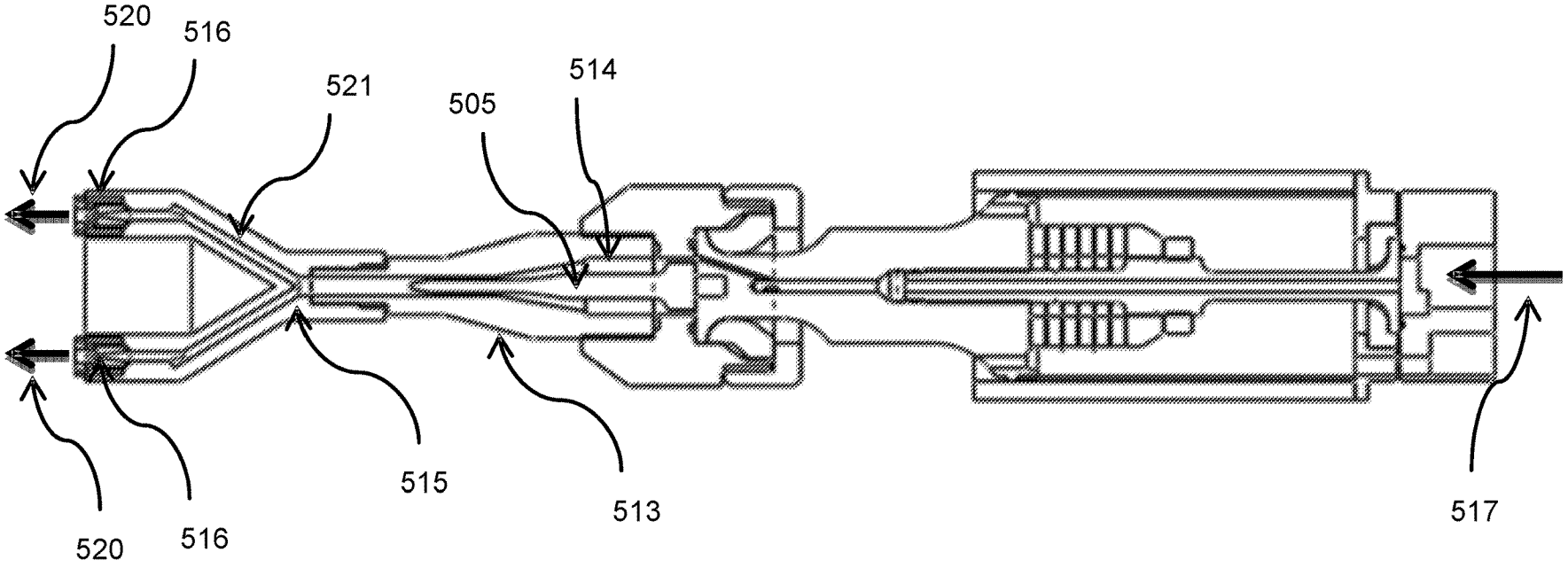
FIG. 5 is a cross-sectional view of a dual-orifice inflow nozzle in accordance with another embodiment.

FIG. 5 is a cross-sectional view of a dual-orifice inflow nozzle in accordance with another embodiment. The geometry and configuration of the ultrasonic transducer section is the same as described above for FIG. 4 (i.e. the single nozzle section). The nozzle has a water inflow inlet for receiving an inflow of water 517. The inlet is aligned with the central longitudinal axis of the nozzle. The microtip 505 (probe) is also aligned with the central longitudinal axis. The nozzle depicted by way of example in FIG. 5 has a nozzle adapter 513, a dual-orifice rotary nozzle head 515, a pair of diverging flow conduits 521, and a pair of nozzle insert units 516 defining exit orifices from which two pulsed jets emerge 520. The water flows from the inflow inlet through the central passageway formed as a bore through the transducer and then past the microtip through channel 514. A high-pressure swivel, not shown in the figure, can be connected in between the nozzle head 515 and the adapter 513. The overall dimensions are 18.5-in in length and 3.0-in in diameter. As noted above, the dimensions are solely presented as an example and should be construed as limiting the invention.

Figure 6:
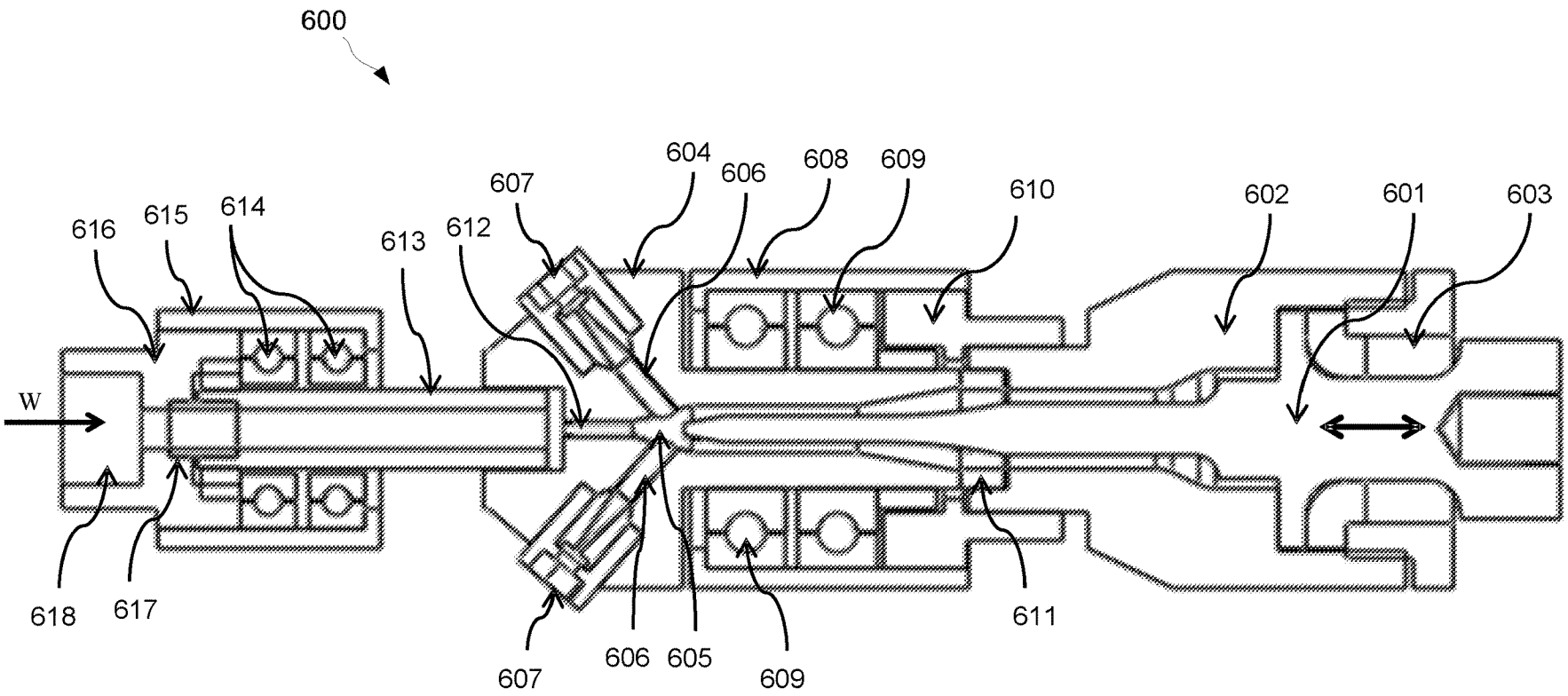
FIG. 6 is a cross-sectional view of a self-rotating nozzle having two angled exit orifices in accordance with another embodiment.

FIG. 6 is a cross-sectional view of a self-rotating nozzle having two angled exit orifices in accordance with another embodiment.

Figure 7A:
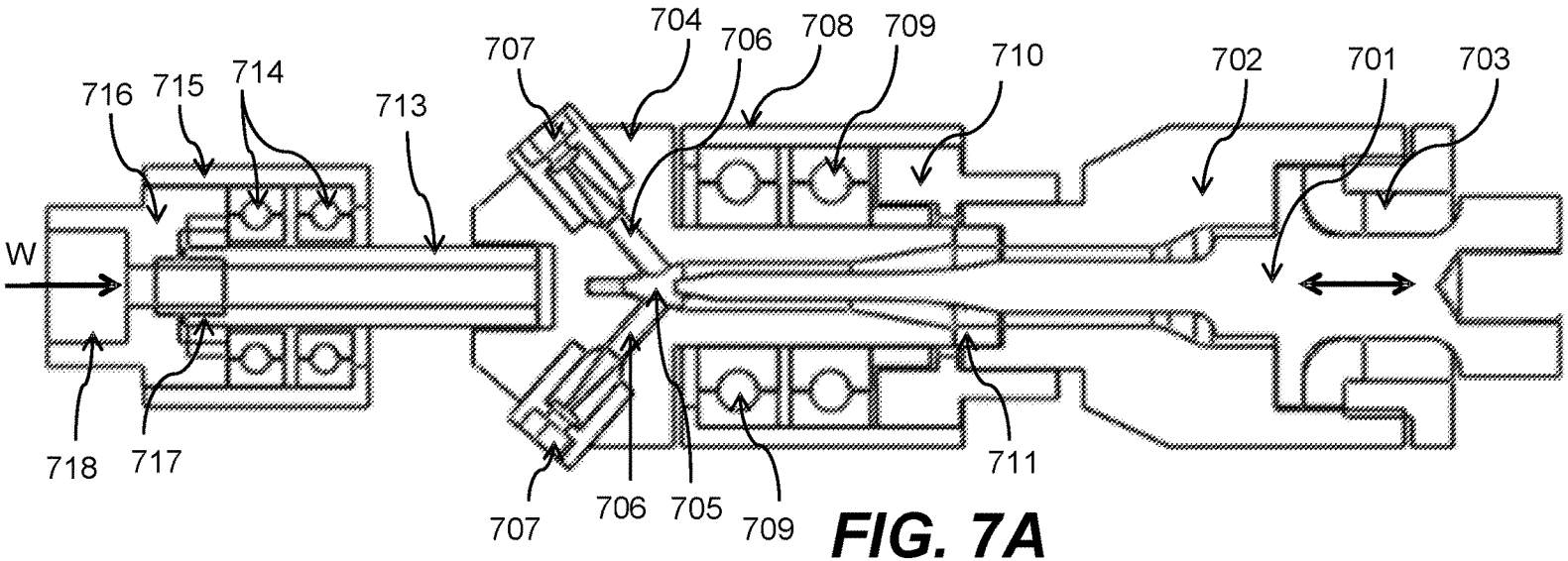
FIG. 7A is a cross-sectional view of another embodiment of a self-rotating nozzle.
Figure 7B:
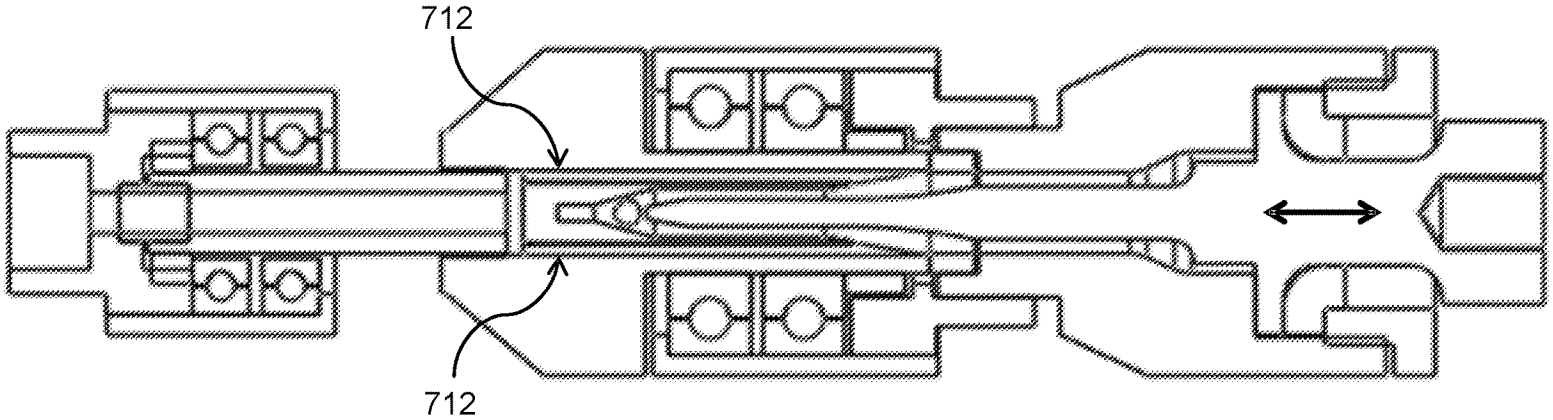
FIG. 7B is a cross-sectional view, orthogonal to the view of FIG. 7A, of the nozzle of FIG. 7A.
Figure 8:
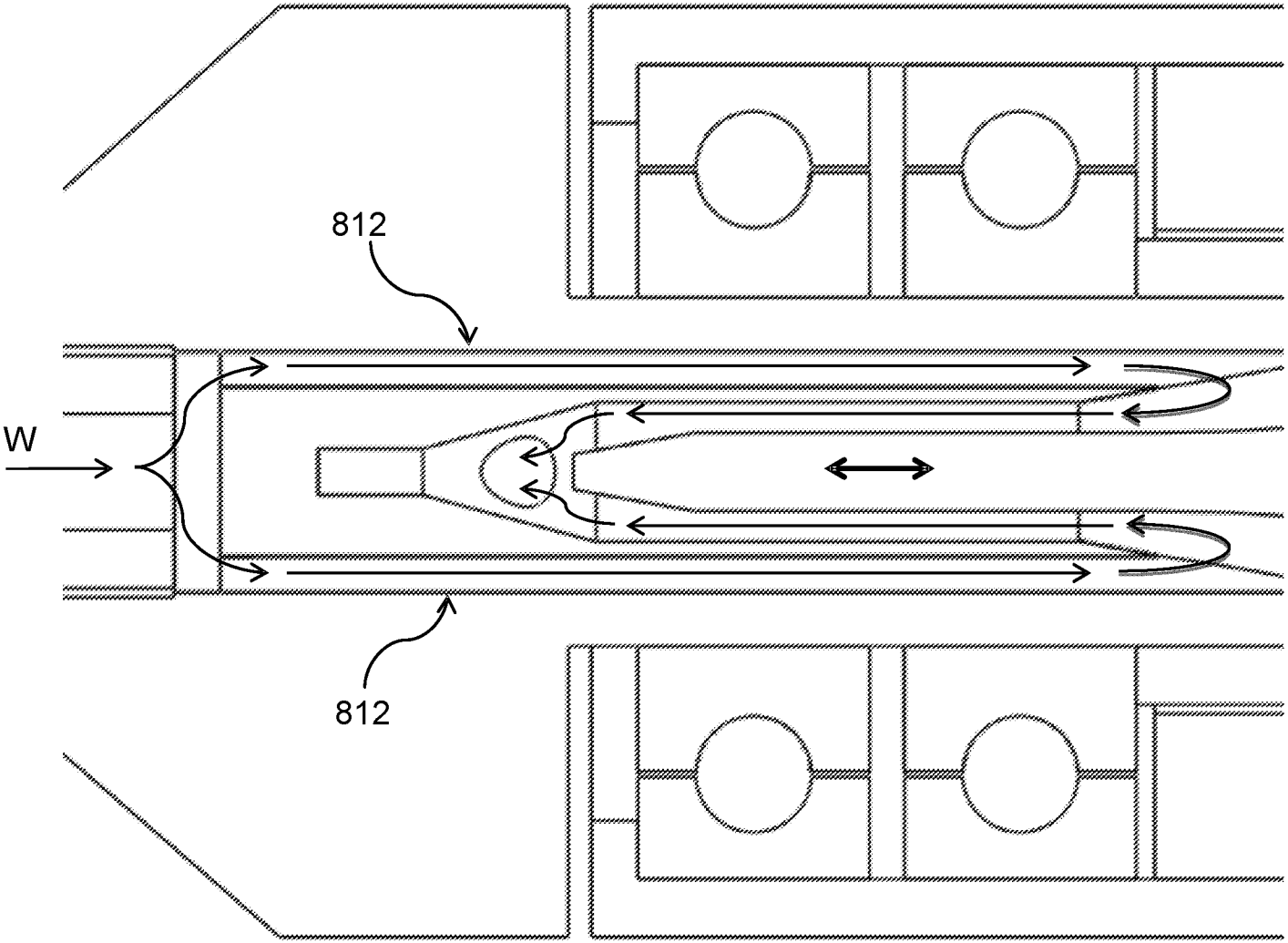
FIG. 8 is a cross-sectional view of an enlarged view of the nozzle of FIGS. 7A and 7B showing the reversing flow path.

As shown in FIG. 6, the high-pressure water flows in a direction generally opposite to the direction of the ultrasonic waves. The nozzle assembly of FIG. 6 is compact and is useful for processing (prepping, removal of coatings) of long (>100-m) curved internal surfaces such as ducts, pipes, and tubes. Two configurations of the rotatable nozzle are described below. In one embodiment shown in FIG. 6, high-pressure water is divided into two or more streams ahead of the probe tip. In the other embodiment, high-pressure water is divided into two or more streams flowing in annular passage surrounding the probe (as shown in FIG. 7A, FIG. 7B and FIG. 8), and then reversing its direction to flow in the same direction as the longitudinal ultrasonic waves. Since the water now flows in the same direction as the waves, the assembly is more efficient.

In the embodiment illustrated in FIG. 6, the nozzle includes a high-pressure chamber unit 601, 602, 603, rotary head 604, 607, and two swivel units, 608, 609, 610, and 611, and 614, 615, 616, and 617. Water (W) enters through the inlet port 618 and passes through the shaft 613. The water then enters the inlet hole 612 on the rotary head 604. At or near the microtip 605 of the probe 601, the water is divided into two discrete streams of water which individually enter the two orifice inserts 607 through the respective holes 606. Two pulsed jets emerge from the rotating inserts 607. In this embodiments, the pulsed jets are angled relative to the axis of rotation. The angle of each of the pulsed jets relative to the axis of rotation may be between 0 and 90 degrees, preferably between 30 and 60 degrees, more preferably between 40 and 50 degrees, more preferably approximately 45 degrees.

The self-rotating nozzle is driven by the forces generated by the jets emerging from the inserts 607, which have offset angles to provide the torque required for rotation. The rotating action is maintained by the swivel unit composed of the housing 608, bearings 609, end nut 610, and high-pressure seal 611 at the upstream of the branching, and the housing 615, bearing 614, end nut 616 and high-pressure seal 617 near the port 618.

The second embodiment, shown in FIG. 7A, FIG. 7B and FIG. 8, includes a high-pressure chamber unit, 701, 702, 703, rotary head 704, 707, and two swivels: a first swivel 708, 709, 710 and 711, and a second swivel 714, 715, 716, and 717.

Water (W) enters water inlet port 718 and passes through the shaft 713. The water is then divided into two discrete streams which each enters inlet holes 712 on the rotary head 704. At the end of the holes 712, the water reverses its direction and enters the annular path around the probe or microtip 701. The stream is modulated at the microtip of the probe 701, and enters orifice inserts 707 through the holes 706, emerging as pulsed waterjets.

The self-rotating nozzle is driven by the forces generated by the jets emerging from the inserts 707 which have offset angles to provide the torque required for rotation. The rotating action is maintained by the swivel unit composed of the housing 708, bearings 709, end nut 710, and high-pressure seal 711, at the upstream end of the branching, and housing 715, bearing 714, end nut 716, and high-pressure seal 717, near the port 718.

FIG. 8 is a cross-sectional view of an enlarged view of the nozzle of FIGS. 7A and 7B showing the reversing flow path 812, which is an annular flow path as shown, i.e. an annular flow-reversing channel surrounding at least part of the microtip.

Figure 9:
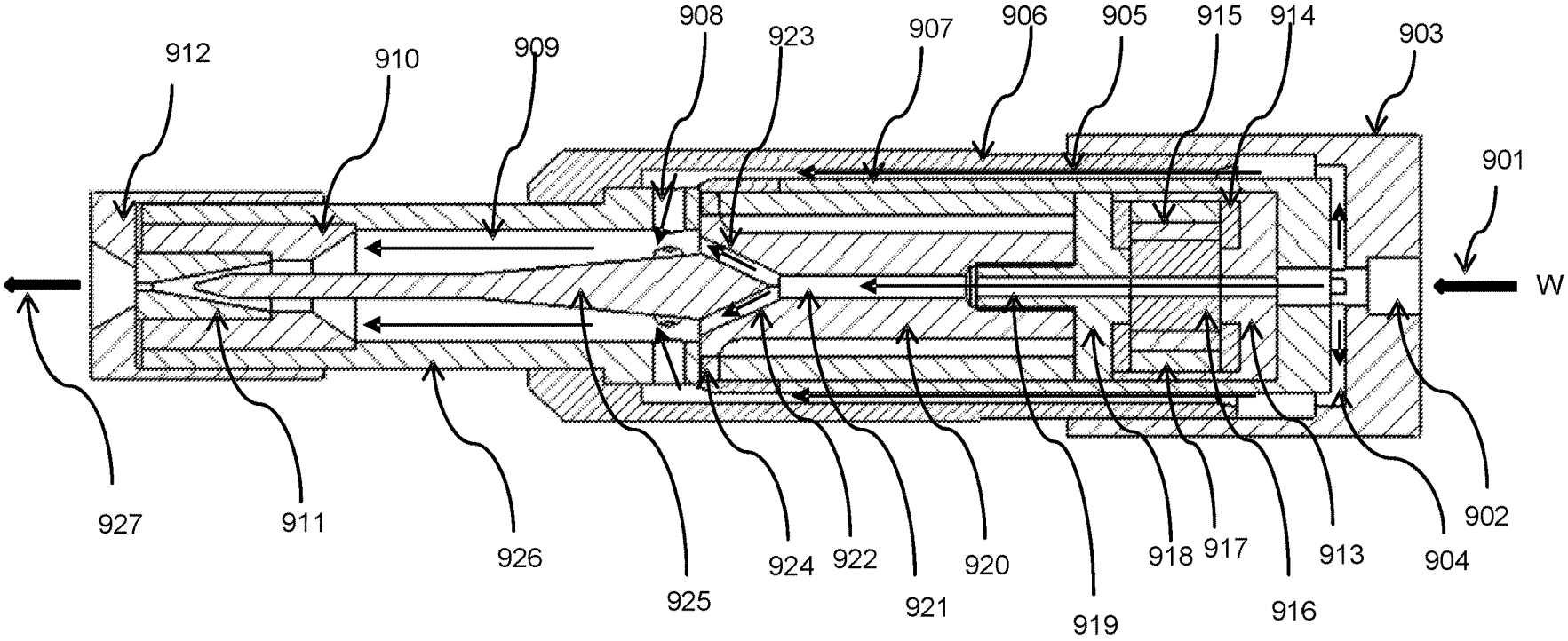
FIG. 9 is a cross-sectional view (with hatching) of an inflow nozzle having a magnetostrictive ultrasonic transducer.

FIG. 9 is a cross-sectional view of an inflow nozzle having a magnetostrictive ultrasonic transducer. High-pressure water 901 enters the nozzle body via the inlet 902. The path of the water is branched into two directions: in one direction the water passes through four grooves 904 in the inner surface of the top housing pipe 903, then flows through the gap 905 which is formed between the bottom pipe 906 inner wall and the covering tube 907 for the transducer driving unit assembly which includes the housing 913, magnetic circuit rings 914, a coil 915, magnetostrictive core 916, magnet ring 917 and a driving shaft 918, and then enters the nozzle chamber 909 through holes 908 on the nozzle chamber housing tube 926; in the other direction, the water from the inlet 902 flows through the center channel 919 of the transducer driving unit assembly and the center 921 of the ultrasonic probe or horn 920, 924, 925, then goes through a branch of two water channels 922, 923, passing by the probe flange 924 and entering the nozzle chamber 909. Finally, the waterjet 927 exits the nozzle assembly. The nozzle assembly includes a nozzle holder 910, a nozzle 911, a nozzle location adjustment tube 912 and a probe tip 925, or microtip.

Figure 10:
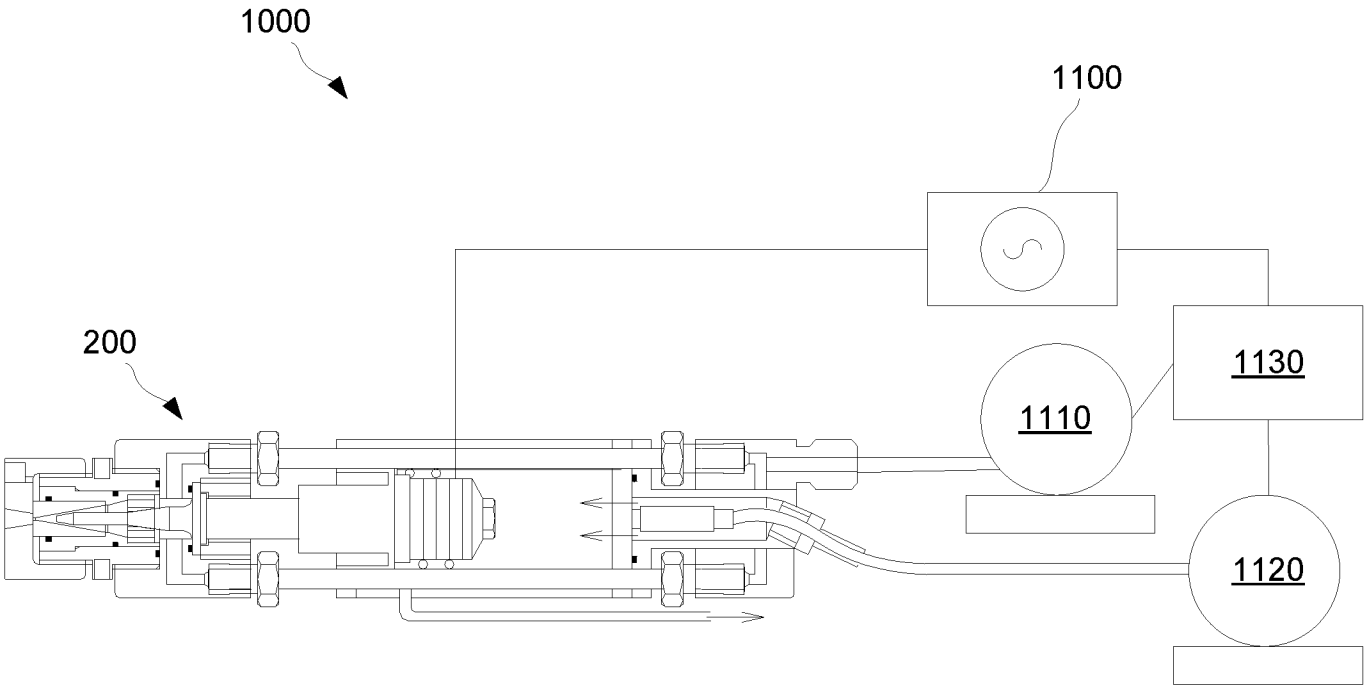
FIG. 10 is a cross-sectional view of a system having the ultrasonically pulsed waterjet nozzle of FIG. 2, an ultrasonic generator, a water pump, an air compressor, and a controller.

FIG. 10 is a cross-sectional view of a pulsed waterjet apparatus 1000 having the ultrasonically pulsed waterjet nozzle 200 of FIG. 2, an ultrasonic generator 1100, a water pump 1110, an air compressor 1120, and a controller 1130.

Figure 11:
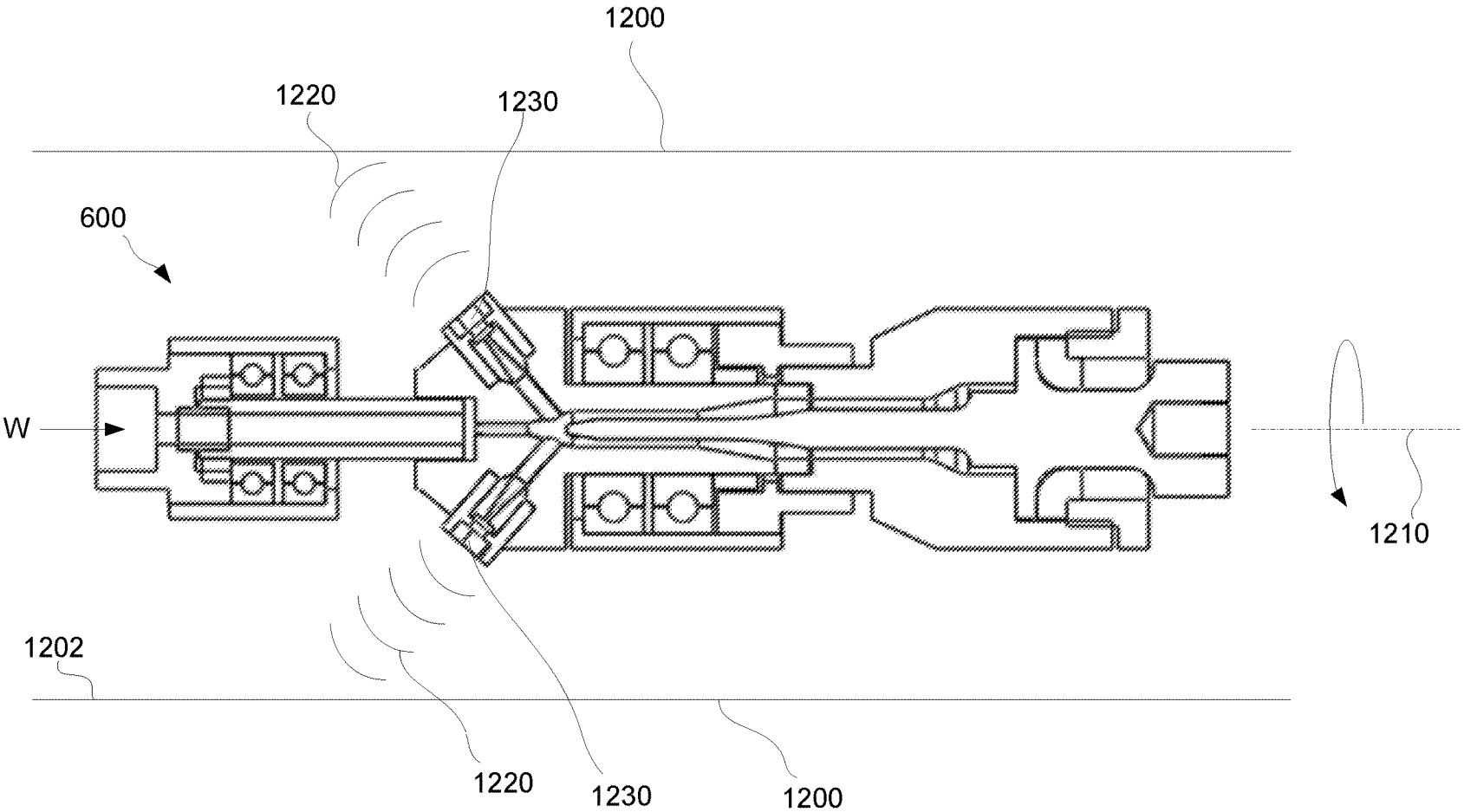
FIG. 11 is a cross-sectional view of the nozzle of FIG. 6 prepping a surface inside a bore.

FIG. 11 is a cross-sectional view of the nozzle 600 of FIG. 6 prepping a surface 1202 inside a bore 1200. The nozzle 600 rotates about an axis of rotation 1210. Pulsed waterjets 1220 exiting from the rearwardly angled orifices 1230 impinge upon the surface 1202 of the bore 1200 to thereby roughen (prepare) the surface of the bore. The prepping of the surface may be a prelude to applying, or reapplying, a coating to the bore. Alternatively, a coating or deposit, or contaminated material (for example, removing a layer of radioactive material in nuclear decommissioning) may be removed from the surface using this nozzle.

It is to be understood that the singular forms "a", "an" and "the" include plural referents unless the context clearly dictates otherwise. Thus, for example, reference to "a device" includes reference to one or more of such devices, i.e. that there is at least one device. The terms "comprising", "having", "including", "entailing" and "containing", or verb tense variants thereof, are to be construed as open-ended terms (i.e., meaning "including, but not limited to,") unless otherwise noted. All methods described herein can be performed in any suitable order unless otherwise indicated herein or otherwise clearly contradicted by context. The use of examples or exemplary language (e.g. "such as") is intended merely to better illustrate or describe embodiments of the invention and is not intended to limit the scope of the invention unless otherwise claimed.

The embodiments of the invention described above are intended to be exemplary only. As will be appreciated by those of ordinary skill in the art, to whom this specification is addressed, many obvious variations can be made to the embodiments present herein without departing from the spirit and scope of the invention. The scope of the exclusive right sought by the Applicant(s) is therefore intended to be limited solely by the appended claims.

The invention claimed is:

1. A pulsed waterjet apparatus comprising:

a water pump for generating a pressurized waterjet;

an ultrasonic signal generator for generating an ultrasonic signal; and an ultrasonic nozzle comprising an ultrasonic transducer comprising a main body and a microtip connected to the main body for converting the ultrasonic signal into vibrations that pulse the pressurized waterjet to generate a pulsed waterjet, an exit orifice through which the pulsed waterjet exits from the ultrasonic nozzle and a water inflow inlet axially aligned with the exit orifice to convey water along a central axis of the ultrasonic nozzle via a central bore in the main body of the ultrasonic transducer, wherein the ultrasonic nozzle comprises a water bypass channel to guide the water around the microtip, and wherein the water bypass channel is an obliquely angled bore extending through the main body of the ultrasonic transducer, and wherein the ultrasonic transducer comprises a piezoelectric stack mounted on a shaft and connected to the main body such that a downstream face of the piezoelectric stack abuts an upstream face of the main body.

2. The pulsed waterjet apparatus of claim 1 wherein the microtip is axially aligned with the exit orifice and the water inflow inlet.

3. The pulsed waterjet apparatus of claim 1 wherein the ultrasonic signal is a 40 kHz signal.

4. The pulsed waterjet apparatus of claim 1 wherein the main body comprises three angled bores providing water bypass channels.

5. The pulsed waterjet apparatus of claim 1, wherein the main body, the shaft, and the microtip are all tuned to half the wavelength of the piezoelectric stack.

* * * * *